US005229691A

United States Patent [19]

Shichao et al.

[11] Patent Number: 5,229,691

[45] Date of Patent: Jul. 20, 1993

[54] ELECTRONIC FLUORESCENT DISPLAY

[75] Inventors: Ge Shichao, Santa Clara; Victor Lam, Saratoga, both of Calif.

[73] Assignee: Panocorp Display Systems, Santa Clara, Calif.

[21] Appl. No.: 730,110

[22] Filed: Jul. 15, 1991

Related U.S. Application Data

[63] Continuation-in-part of Ser. No. 657,867, Feb. 25, 1991, Pat. No. 5,170,100.

[51] Int. Cl.[5] ..... G09G 1/04; H01J 29/70; H01J 1/88

[52] U.S. Cl. ..... 315/366; 313/422; 313/292

[58] Field of Search ..... 315/366; 313/422, 456, 313/238, 250, 265, 292

[56] References Cited

U.S. PATENT DOCUMENTS

| | | | |
|---|---|---|---|
| 2,500,929 | 3/1950 | Chilowsky | 313/422 |
| 3,935,499 | 1/1976 | Oess . | |
| 3,935,500 | 1/1976 | Oess et al. . | |
| 4,377,769 | 3/1983 | Beatty et al. . | |
| 4,707,638 | 11/1987 | Hara et al. . | |
| 4,719,388 | 1/1988 | Oess . | |
| 4,737,683 | 4/1988 | Shichao et al. . | |
| 4,811,017 | 11/1989 | Tsuruoka | 313/495 |
| 4,812,716 | 3/1989 | Miyama et al. | 315/366 |
| 4,973,888 | 11/1990 | Morimoto et al. | 315/366 |
| 5,083,058 | 1/1992 | Nonomura et al. | 313/482 |

FOREIGN PATENT DOCUMENTS 62-150638 12/1988 Japan .

*Primary Examiner*—Gregory C. Issing
*Attorney, Agent, or Firm*—Majestic, Parsons, Siebert & Hsue

[57] ABSTRACT

In a cathodoluminescent display device, spacer elements are used to provide rigid mechanical support between the face and back plates when the chamber of the device is evacuated so that thin face and back plates may be used even for large-screen displays. The spacer support includes a spacer plate having holes therein for passage of electrons between the anode and cathode where a predetermined small number of one or more pixel dots corresponds to and spatially overlaps one hole, thereby reducing crosstalk. Shadow-reducing electrodes are employed on the back plate and spacer members alongside the cathode to cause the path of electrons from the cathode to the anode to bend towards the spacer members in order to reduce shadows caused by the presence of the spacer members. Various configurations of the two or three sets of grid electrodes may be employed to improve resolution and focusing. A linear array of cathode filament segments is used instead of one long integral cathode wire where the ends of the segments overlap to eliminate any visible gaps caused by the end portions of the segments being at lower temperatures than intermediate portions.

23 Claims, 5 Drawing Sheets

ELECTRONIC FLUORESCENT DISPLAY

CROSS REFERENCE TO RELATED APPLICATION

This application is a continuation-in-part application of Ser. No. 657,867 filed Feb. 25, 1991, now U.S. Pat. No. 5,170,100 hereinafter referred to as the "parent application." The parent application is incorporated herein by reference in its entirety.

BACKGROUND OF THE INVENTION

This invention relates in general to electronic fluorescent display devices and in particular, to an improved low voltage cathodoluminescent device particularly useful for full color hang-on-wall type displays.

Researchers in many flat panel display technologies, such as LCD, PDP, EL, LED, VFD, flat CRT, have been trying to develop a full-color hang-on-wall television. Color televisions of several inch to ten inch screens using LCD technology have been produced. Such televisions using LCD employ a large number of thin film transistors on their basic boards and are expensive. Because of difficulty of manufacture, it is difficult to further increase the size of the basic board and of the television screen of such products. LCD televisions employ a back illumination scheme. The basic board with thin film transistors transmits a low proportion of light from a light source and this limits the brightness of the display. Because of these difficulties, in order to develop larger color televisions using LCD technology, research in this area is primarily focused on projection televisions.

Color televisions using PDP technology is still in the research stage and at this point, color televisions of twenty inch screen have been proposed. The main problems in the development of PDP type color televisions include its low efficiency in phosphorescence, its complicated drive circuitry, unevenness in brightness and short product life. Research in LED, EL still has not been able to develop luminescent elements for blue lights. While multi-color displays have been developed using VFD, such devices are limited to smaller television screens. Furthermore, aside from the use of luminescent elements using zinc oxide and zinc for generating blue-green light, the brightness, efficiency and product life of other color phosphors are still not satisfactory. From the above, it will be evident that large-screen flat full-color hang-on-wall televisions that have been proposed using any of the existing flat panel display technologies are not entirely satisfactory.

Cathode ray tubes (CRT) have been used for display purposes in general, such as in conventional television systems. The conventional CRT systems are bulky primarily because depth is necessary for an electron gun and an electron deflection system. In many applications, it is preferable to use flat display systems in which the bulk of the display is reduced. In U.S. Pat. No. 3,935,500 to Oess et al., for example, a flat CRT system is proposed where a deflection control structure is employed between a number of cathodes and anodes. The structure has a number of holes through which electron beams may pass with sets of X-Y deflection electrodes associated with each hole. The deflection control structure defined by Oess et al. is commonly known as a mesh-type structure. While the mesh-type structure is easy to manufacture, such structures are expensive to make, particularly in the case of large structures.

Another conventional flat panel system currently used is known as the Jumbotron such as that described in Japanese Patent Publication Nos. 62-150638 and 62-52846. The structure of Jumbotron is somewhat similar to the flat matrix CRT described above. Each anode in the Jumbotron includes less than 20 pixels so that it is difficult to construct a high phosphor dot density type display system using the Jumbotron structure.

Both the flat matrix CRT and Jumbotron structures are somewhat similar in principle to the flat CRT system described by Oess et al. discussed above. These structures amount to no more than enclosing a number of individually controlled electron guns within a panel, each gun equipped with its own grid electrodes for controlling the X-Y addressing and/or brightness of the display. In the above-described CRT devices, the control grid electrodes used are in the form of mesh structures. These mesh structures are typically constructed using photo-etching by etching holes in a conductive plate. The electron beams originating from the cathodes of the electron guns then pass through these holes in the mesh structure to reach a phosphor material at the anodes. As noted above, mesh structures are expensive to manufacture and it is difficult to construct large mesh structures. For this reason, each cathode has its own dedicated mesh structure for controlling the electron beam originating from the cathode. Since the electron beam must go through the hole in the mesh structure, a large number of electrons originating from the cathode will travel not through the hole, but lost to the solid part of the structure to become grid current so that only a small portion of the electrons will be able to escape through the hole and reach the phosphor material at the anode. For this reason the osmotic coefficient, defined as the ratio of the area of the hole to the area of the mesh structure of the cathode, of the above-described devices is quite low.

As taught in the parent application, to avoid the problem of low osmotic coefficient in conventional devices, instead of using individually controlled electron guns, two or more sets of elongated grid electrodes may be employed for scanning and controlling the brightness of pixels at the entire anode where the area of the grid electrodes that blocks electrons is much smaller than the area of the mesh structure of the conventional devices.

The above-described CRT devices have another drawback. In the case of the Jumbotron, each electron gun is used for scanning a total of 20 pixels. In the Oess et al. patent referenced above, each electron beam passing through a hole is also used for addressing and illuminating a large number of pixels. When illumination at a particular pixel is desired, certain voltages are applied to the X-Y deflection electrodes on the inside surface of the hole, causing electrons in the electron beam passing through the hole to impinge the anode at such pixel. However, electrical noise and other environmrntal factors may cause the electron beam in the Oess et al. system and the Jumbotron to deviate from its intended path. Furthermore, certain electrons will inevitably stray from the electron beam and land in areas of the anode which is different from the pixel that is addressed. This causes pixels adjacent to the pixel which is addressed to become luminescent, causing crosstalk and degrades the performance of the display.

As is known to those skilled in the art, the inner chamber of a cathodoluminescent visual display device must be evacuated so that the electrons emitted by the cathode would not be hindered by air particles and are free to reach phosphor elements at the anode. For this reason, the housing for housing the cathode, anode and control electrodes must be strong enough to withstand atmospheric pressure when the chamber within the housing is evacuated. When the display device has a large surface area, as in large screen displays, the force exerted by the atmosphere on the housing can be substantial when the chamber within the housing is evacuated. For this reason, conventional cathodoluminescent display devices have employed thick face and back plates to make a sturdy housing. Such thick plates cause the housing to be heavy and thick so that the device is heavy, and expensive and difficult to manufacture. It is therefore desirable to provide an improved cathodoluminescent visual display device where the above-described difficulties are not present.

SUMMARY OF THE INVENTION

This invention is based on the observation that, to reduce crosstalk between adjacent pixels or pixel dots, a spacer plate is employed with holes therein for passage of electrons between the anode and cathode, where a predetermined number of one or more pixel dots correspond to and spatially overlap one hole, thereby reducing crosstalk. In the preferred embodiment, a small number of pixel dots, such as two, four or six pixel dots, correspond to and spatially overlap one hole.

One aspect of the invention is directed towards a cathodoluminescent visual display device having a plurality of pixel dots. The device comprises a housing defining a chamber therein, the housing having a face plate and a back plate. The device also includes an anode on or near the face plate, luminescent means that emits light in response to electrons, and that is on or adjacent to the anode; at least one cathode in the chamber between the face and back plates; and at least a first and a second set of elongated grid electrodes between the anode and cathode. The electrodes in each set overlap the luminescent means, cathode and electrodes in at least one other set at points, wherein the overlapping points define pixel dots. The device further includes means for heating the cathode, causing the cathode to emit electrons, means for applying electrical potentials to the anode, cathode and the two or more sets of grid electrodes, causing the electrons emitted by the cathode to travel to the luminescent means at the pixel dots on or adjacent to the anode for displaying images. The device also includes spacer means connecting the face and back plates to provide mechanical support for the plates so that the housing would not collapse when the housing is evacuated. The spacer means includes a spacer plate defining holes therein for passage of electrons between the anode and cathode. A predetermined number of one or more pixel dots correspond to and spatially overlap one hole. The spacer plate reduces crosstalk.

In the preferred embodiment of the invention, the spacer means also includes at least one net-shaped structure defining meshes that each permits electron passage to address a plurality of pixel dots. The structure and the spacer plate rigidly connect the face and back plates. In the preferred embodiment, the spacer means also includes elongated spacer members adjacent to the cathode. Portions of the spacer plate, the structure and the spacer members abut each other and the face and back plates along a line normal to the face and back plates forming a rigid support for the face and back plates along the line. Also in the preferred embodiment, the holes and the spacer plate are tapered and may include separation walls to separate each hole into smaller holes that match individual pixel dots to further reduce crosstalk between adjacent pixel dots.

For large displays, it is desirable for the cathode to be broken up into shorter filaments to reduce the amount of sagging and for easier handling. One common problem in cathodoluminescent visual display systems is that the two ends of the filament in a cathode are colder than the intermediate portion and, for that reason, emits fewer electrons compared to the intermediate portion. When a long cathode is broken up into shorter filament segments, the above problem of inefficient electron emission at the ends of the filament is compounded. This invention is also based on the observation that, by arranging the filaments so that an end portion of each filament segment is approximate to and overlaps an end portion of a different filament segment, the above-described problem is alleviated. Therefore, another aspect of the invention is directed towards a cathodoluminescent visual display device which includes an anode, a luminescent means that emits light in response to electrons, and that is on or adjacent to the anode and at least one cathode. The device includes also at least a first and a second set of elongated grid electrodes between the anode and cathode for scanning and controlling the brightness of the device and means for applying electrical potentials to the anode, the at least one cathode and the sets of grid electrodes, means for heating the cathode causing the cathode to emit electrons and a housing for holding the anode, cathode, grid electrodes and luminescent means. The electrons emitted by the cathode travel to the luminescent means at the pixel dots on or adjacent to the anode for displaying images. The cathode includes at least two elongated filaments, each having two ends, and means connecting the filaments to the housing. The electrons emitted by one filament travel to the luminescent means at pixel dots that are substantially non-overlapping with the pixel dots reached by the electrons emitted by the other filament. The two filaments are arranged with an end portion of one filament being proximate to and overlapping an end portion of the other filament so as to reduce the adverse effects caused by such end portions being at a lower temperature compared to the remaining portions of the filament.

Another aspect of the invention is directed towards the use of at least two sets of elongated grid electrodes for scanning and for controlling the brightness of the pixel dots. The device according to this aspect includes an anode, luminescent means, a cathode, means for heating the cathode, at least a first and a second set of elongated grid electrodes all essentially as described above, and means for applying electrical potentials to the anode, cathode and the grid electrodes, causing electrons emitted by the cathode to travel to the luminescent means at the pixel dots on or adjacent to the anode for displaying images. The potentials applied are so that the first set of grid electrodes is used for scanning and the second set of electrodes is used for controlling the brightness of the pixel dots.

Yet another aspect of the invention is directed towards reducing any shadows caused by spacer members used to support the face and back plates. Such device includes a housing defining a chamber therein, said housing having a face plate and a back plate, said device further including an anode on or near the face plate and luminescent means that emits light in response to electrons, and that is on or adjacent to the anode. The device includes at least one elongated cathode in the chamber between the face and the back plates, at least a first and a second set of elongated grid electrodes between the anode and cathode and means for heating the cathode causing the cathode to emit electrons. The grid electrodes in each set overlaps the luminescent means, cathode and electrodes in at least one other set at points, wherein the overlapping points define pixel dots. The device includes also means for applying electrical potentials to the anode, cathode and the two or more sets of grid electrodes and spacer means connecting the face and back plates to provide mechanical support for the plates so that the housing would not collapse when the chamber is evacuated. The electrons emitted by the cathode travel to the luminescent means at the pixel dots on or adjacent to the cathode for displaying images. The spacer means includes elongated spacer members alongside and not overlapping the cathode. The members are located between the back plate and the grid electrodes, between the sets of grid electrodes or between the grid electrodes and the anode. The device further includes a first set of one or more elongated shadow reducing electrodes not overlapping the cathode. The potential applying means applies to the shadow reducing electrodes, a potential that is higher than that applied to the cathode by the potentials applying means, causing electrons emitted by the cathode to bend sideways before traveling towards the anode to thereby reduce any shadows caused by the spacer members.

Another aspect of the invention is directed towards a cathodoluminescent visual display apparatus comprising a mosaic of devices arranged side by side to form a larger display. Each of the devices includes the components of the device described above, where each device includes a spacer means, said spacer means including a spacer plate defining holes therein for passage of electrons between the anode and cathode, wherein a predetermined number of one or more pixel dots correspond to and spatially overlap one hole, thereby reducing crosstalk.

This invention enables full-color hang-on-wall televisions with screen size from several inch to one hundred inch to be manufactured. Such televisions generate a full range of colors of high resolution and brightness and have housings that are relatively thin even with large screen size televisions. The spacer means used for supporting the face and back plates enable the thin display housings to have sufficient mechanical strength even in large screen displays. The display has reduced crosstalk and shadow reducing electrodes enable the display to have even brightness despite the use of spacers. The arrangement of grid electrodes also enable the display to have improved focusing and resolution.

DETAILED DESCRIPTION OF THE PREFERRED EMBODIMENT

Figure 1B:
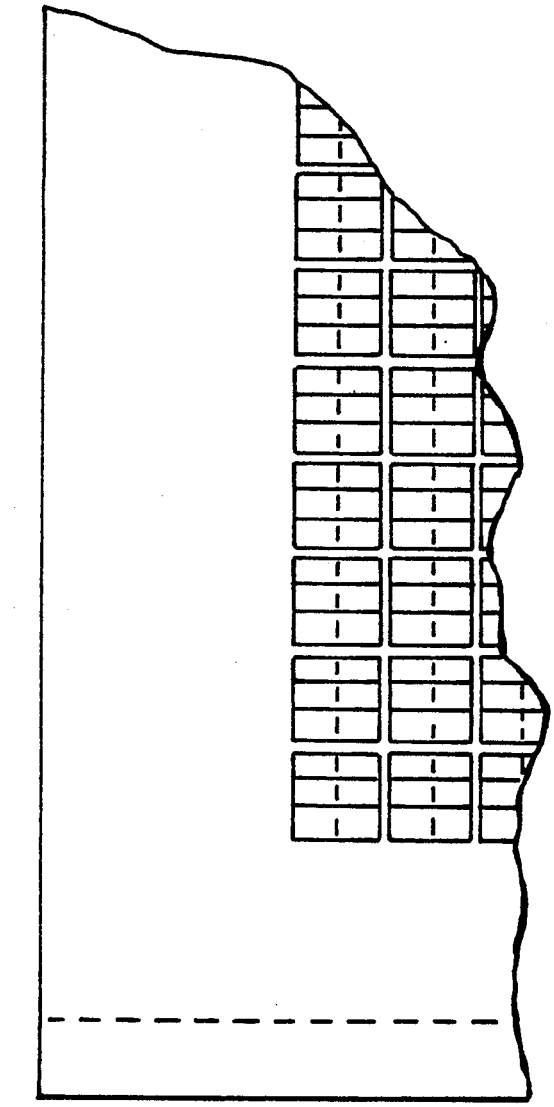
FIG. 1B is a front view of the device of FIG. 1A but where the current source of FIG. 1A is not shown.
Figure 1A:
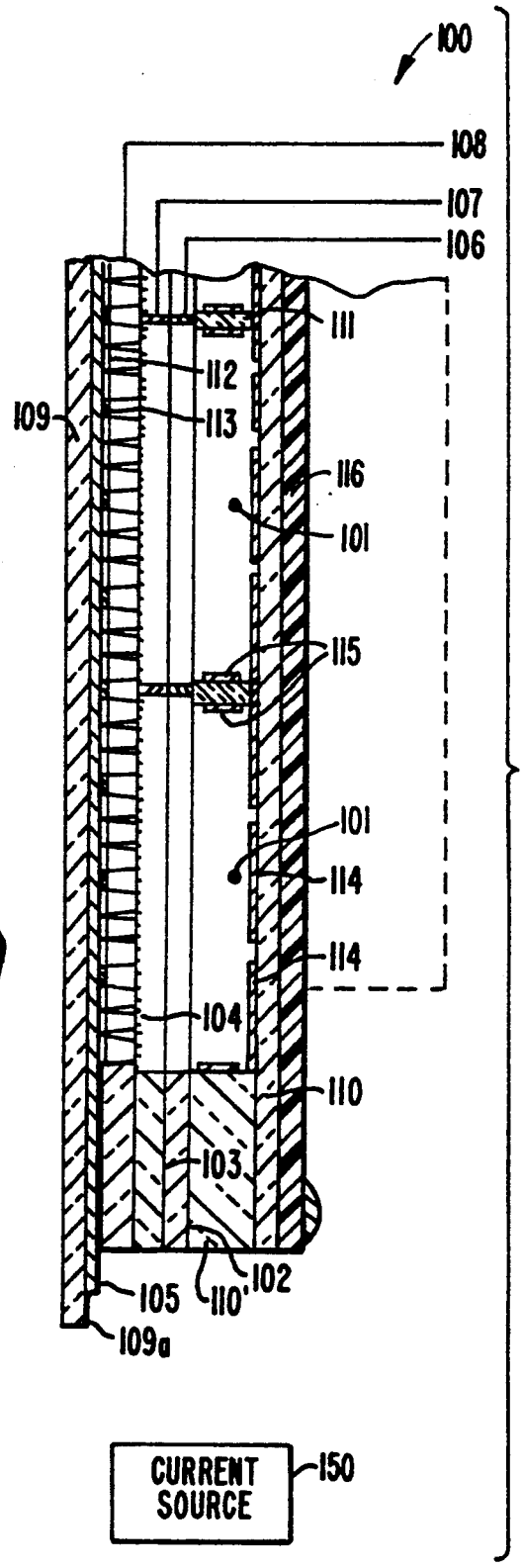
FIG. 1A is a cross-sectional view of a portion of a cathodoluminescent visual display device to illustrate the preferred embodiment of the invention.

FIG. 1A is a cross-sectional view of a portion of a flat panel cathodoluminescent visual display device 100 and of a current source 150 for supplying power to device 100 to illustrate the preferred embodiment of the invention. FIG. 1B is a front view of device 100 of FIG. 1A. Device 100 includes cathodes 101, three sets of grid electrodes 102, 103, 104 anode 105 and spacers 106, 107 and 108. These electrodes and parts are sealed in a chamber enclosed by face plate 109 and back plate 110 and side plate 110' where the face, back and side plates form a portion of a housing for a flat vacuum device. The chamber of device 100 enclosed by the face, side and back plates is evacuated so that the electrons generated at the cathodes travel freely towards the anode in a manner described below.

Cathodes 101 form a group of substantially parallel direct heated oxide coated filaments. Each of the three sets of grid electrodes 102, 103 and 104 comprises substantially parallel thin metal wires. In the preferred embodiment in FIG. 1A, between the first set of grid electrodes 102 referred to below as G1 and back plate 110 is a group of substantially parallel elongated spacer members 111 placed alongside filaments 101 and are preferably parallel to the filaments 101. Metal wires G1 are attached to spacers 111 and 106 to reduce the amplitude of their vibrations caused by any movements of the device. Between the first set of grid electrodes 102 (G1) and the second set of electrodes 103 (G2) is a spacer structure 106 which is net-shaped, the structure defining meshes therein, each permitting electron passage between the cathode and the anode to address a plurality of of pixel dots. Between the second set of grid electrodes 103 (G2) and a third set of grid electrodes 104 (G3) is another spacer structure 107 preferably similar in structure to structure 106. These two spacer structures separate the three sets of grid electrodes. The wires of the three sets of grid electrodes may be attached to these two spacer structures as well to reduce vibrations.

On the inside surface 109*a* of face plate 109 is anode 105 comprising a layer of transparent conductive film having three primary color low voltage cathodoluminescent phosphor dots 112, and black insulation layer 113 between the phosphor dots to enhance contrast. Between anode 105 and the third set of electrodes 104 (G3) is a spacer plate 108 having holes therein, where the holes overlap and match the phosphor dots and anode. This means that each hole in spacer plate 108 corresponds to a small number of a predetermined group of pixel dots forming a pixel, and has substantially the same size and shape as the pixel and is located in plate 108 such that its location matches that of its corresponding pixel, so that electrons from the cathode may reach any part of the corresponding phosphor dots in the pixel through such hole and not the insulating layer 113 surrounding such pixel. The Wires of electrodes G3 are attached to and placed between spacer plate 108 and spacer structure 107.

As described in more detail below, the inside surface of back plate 110 and the surfaces of elongated spacer members 106 have shadow reducing electrodes 114, 115 respectively for improving brightness uniformity of the display. The outside surface of back plate 110 is attached to printed circuit board 116 to which are soldered input and output leads for the cathode, anode and the three sets of grid electrodes. Cathodes 101 are connected to a current source 150 (connections not shown in FIG. 1A) for heating the cathode filaments. Other than source 150, the drive electronics for device 100 has been omitted to simplify the diagram.

When source 150 supplies current to cathodes 101, the cathode filaments are heated to emit electrons. These electrons are attracted towards the anode to which a high positive voltage has been applied relative to the cathodes. The paths of electrodes when traveling towards the anode are modulated by voltages applied to the three sets of grid electrodes so that the electrons reach each phosphor dot at the appropriate pixels addressed or scanned for displaying color images.

Figures 2A, 2B:
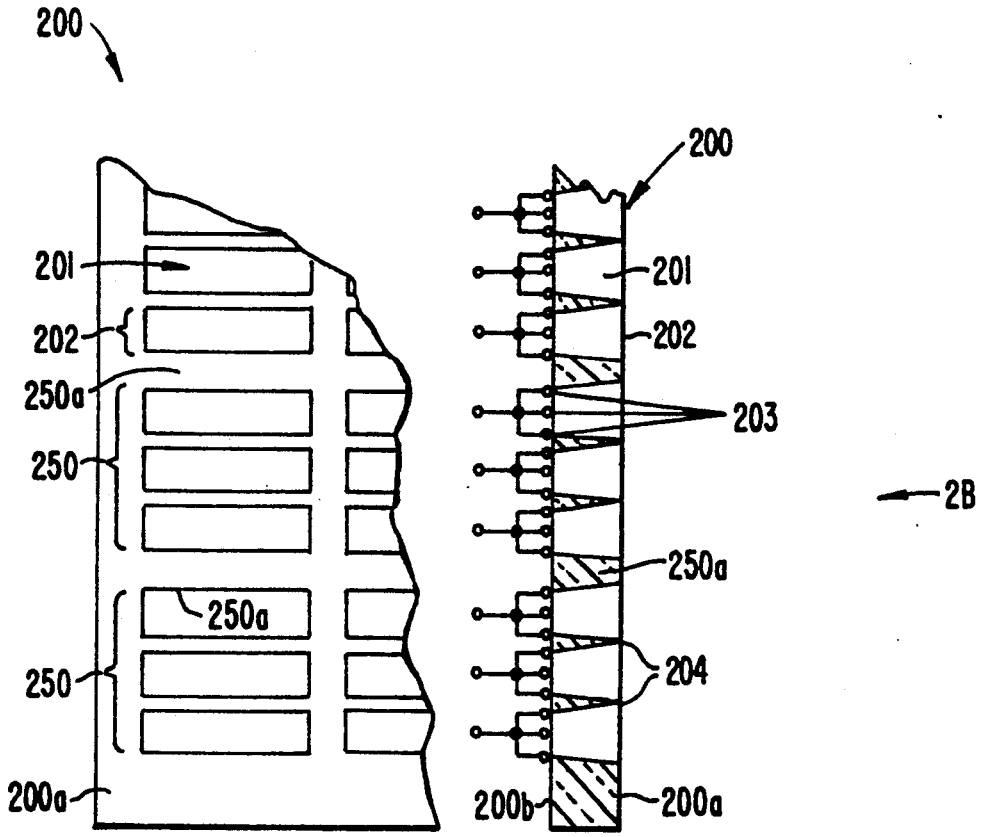
FIG. 2A is a cross-sectional view of a portion of a spacer plate in the device of FIG. 1A and of grid electrodes used for modulating the brightness of the display.
FIG. 2B is a front view of a portion of the spacer plate shown in FIG. 2A.

As discussed above, electrical noise and stray electrons in conventional CRT systems frequently cause pixels adjacent to the pixel addressed to become luminescent, resulting in crosstalk and degradation of the performance of the CRT device. Crosstalk is reduced by means of the spacer plate 108 which is shown in more detail in FIGS. 2A, 2B. FIG. 2A is a cross-sectional view of a spacer plate 200 and FIG. 2B is a front view of spacer plate 200 from direction 2B in FIG. 2A, where the electrodes of FIG. 2A have been omitted to simplify the figure in FIG. 2B. The spacer plate 200 is preferably made of a photosensitive glass-ceramic material; in the preferred embodiment plate 200 is made of a lithium silicate glass matrix with potassium and aluminum modifiers sensitized by the addition of trace amounts of silver and cerium. Holes 201 in plate 200 may be formed by photo-etching. Holes 201 may have slanted surfaces so that their ends 202 at the front surface 200*a* are larger than the ends of the holes at the rear surface 200*b* of the plates. The ends 202 of the holes 201 at the front surface 200*a* are each substantially of the same size as its corresponding phosphor or pixel dots where the locations of the holes 201 are such that ends 202 match and overlap substantially its corresponding pixel dots. Holes 201 are substantially rectangular in shape, matching the shape of their corresponding pixel dots.

At the ends of holes 201 at rear surface 200*b* are a number of grid wires 203 (wires in the third set of electrodes 104 in FIG. 1A) substantially parallel to the long sides of holes 201. One or more wires 203 are aligned with each hole; if more than one wire overlaps a hole which is the case shown in FIG. 1A where three wires overlap one hole, the wires overlapping the same hole are electrically connected to form an electrode. Such electrodes formed by one or more grid wires may be used for controlling the brightness of the pixel dot corresponding to such hole by controlling the voltages of the electrode. As shown in FIG. 2B, each pixel 250 may correspond to three adjacent holes 201 corresponding to three phosphor pixel dots with one red, one blue and one green phosphor dot. The arrangement of holes 201 in plate 200 may be viewed as a big hole 250 corresponding to a single pixel of the display, where plate 200 has two separation walls 204 for each hole 250 dividing the hole into three smaller holes 201, each smaller hole matching, overlapping and corresponding to a red, blue or green phosphor dot of the pixel.

Separation walls 204 reduce or eliminate crosstalk between adjacent phosphor dots of the same pixel, so that color purity of the display is much improved. As shown in FIG. 2A, separation walls 204 are wedge-shaped, with the thin end of the wedge facing surface 200*a* to minimize any dark shadows cast by the separation walls on the image displayed. In reference to FIGS. 2A, 1A, electrons originating from cathodes 101 would enter holes 201 through the ends of the holes at the rear surface 200*b* of spacer plate 200 and emerge at ends 202 of the holes. Since ends 202 of the holes overlap and match their corresponding phosphor and pixel dots, the electrons impinge on such dots, causing the appropriate dot addressed to become luminescent for displaying images.

The entire spacer arrangement of the display device of FIG. 1A will now be described by reference to FIGS. 1A and 2A. In reference to FIG. 1A, spacer structures 106 and 107 each comprises a net-shaped structure which may simply be composed of a first array of substantially parallel bars rigidly connected to a second array of substantially parallel bars where the two sets of bars are substantially perpendicular to one another, defining meshes between any pair of adjacent bars in the first set and another pair of adjacent bars in the second set. Preferably, each mesh is large in area to encompass a number of pixels so that electrons passing between the cathodes and anode destined for such pixels will pass through such mesh, where the bars do not block a high percentage of the electrons generated.

The two spacer structures 106, 107 and spacer plate 108 (200 in FIG. 2A) are stacked in such a manner to provide a strong rigid support for the face and back plates 109, 110. As shown in FIG. 1A, wall 250*a* (not so labelled in FIG. 1A) of spacer plate 108 (same as plate 200 of FIG. 2A) is aligned with a bar in structure 107 and another bar in structure 106 as well as with spacer members 111 along a line which is substantially normal to face and back plates where the face and back plates are substantially parallel. In such manner, the aligned portions of spacer plate 108, structures 106, 107 and spacer member 111 abut one another and the face and back plates, forming a support for the face and back plates along a line normal to the face and back plates. Obviously, structures 106, 107, plate 108 and member 111 may include other portions which are not aligned along a line normal to the face and back plates and the face and back plates need not be parallel to each other; all such configurations are within the scope of the invention. With such rigid support for the face and back plates, the area of the screen of display 100 may be very large while the face and back plates may be made with relatively thin glass. Despite the relatively thin face and back plates, the spacer arrangement described above results in a mechanically strong housing structure adequate for supporting a large screen housing for the display when the housing is evacuated.

To minimize undesirable shadows in the display, rigid support is provided through portions of the spacer plate 108, structures 106, 107 and members 111 that correspond to portions of the screen between adjacent pixels. The thicknesses of wedges 204 at the front surface 200*a* of the spacer plate 200 (108) are smaller than or equal to the separation between adjacent pixel dots. To construct very large screen televisions, for ease of manufacture, spacer plate 108 and spacer structures 106, 107 may be constructed from smaller plates and structures in constructing a larger plate or structure using such smaller plates and structures by placing the smaller plates or structures in the same plane adjacent to one another in a two-dimensional array to form a larger plate or structure.

Figures 3C, 3D:
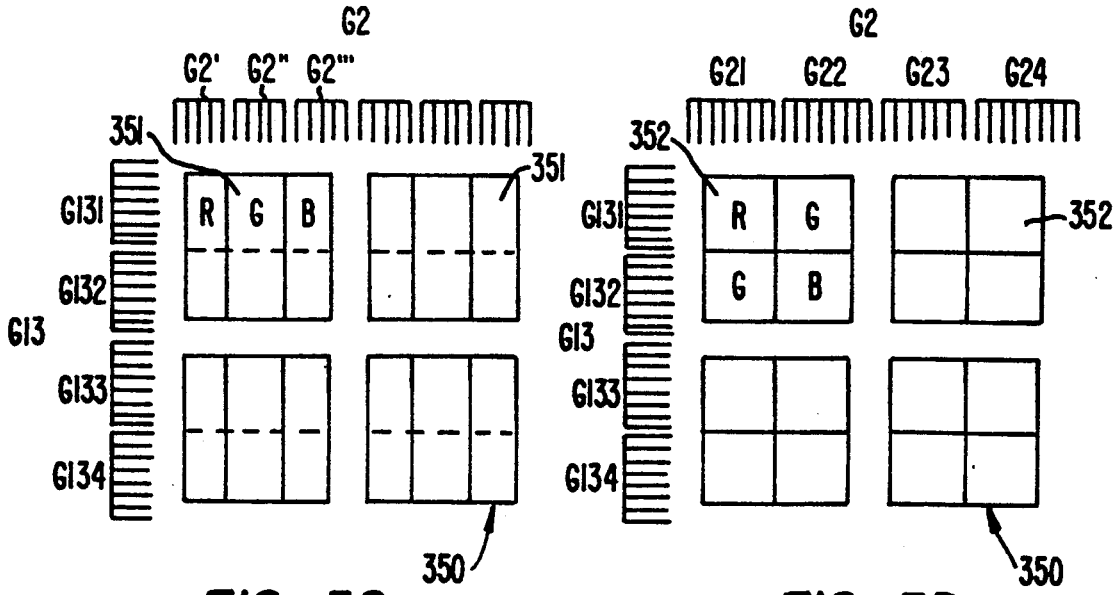
FIG. 3C is a schematic view of an arrangement of the pixel dots in a pixel.
FIG. 3D is a schematic view of another arrangement of pixel dots within a pixel.
Figure 3B:
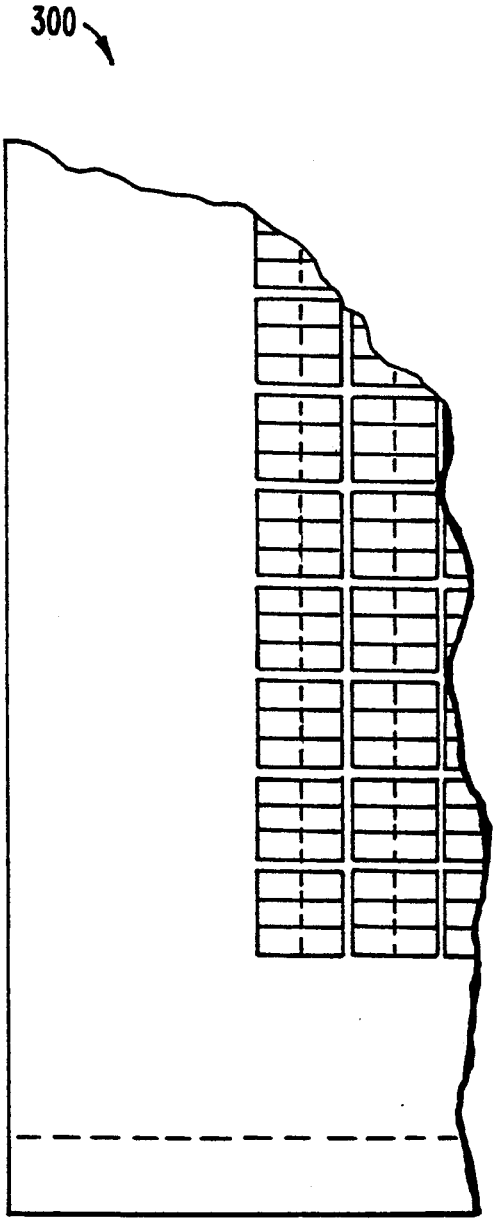
FIG. 3B is a front view of the portion of the device 300 in FIG. 3A.
Figure 3A:
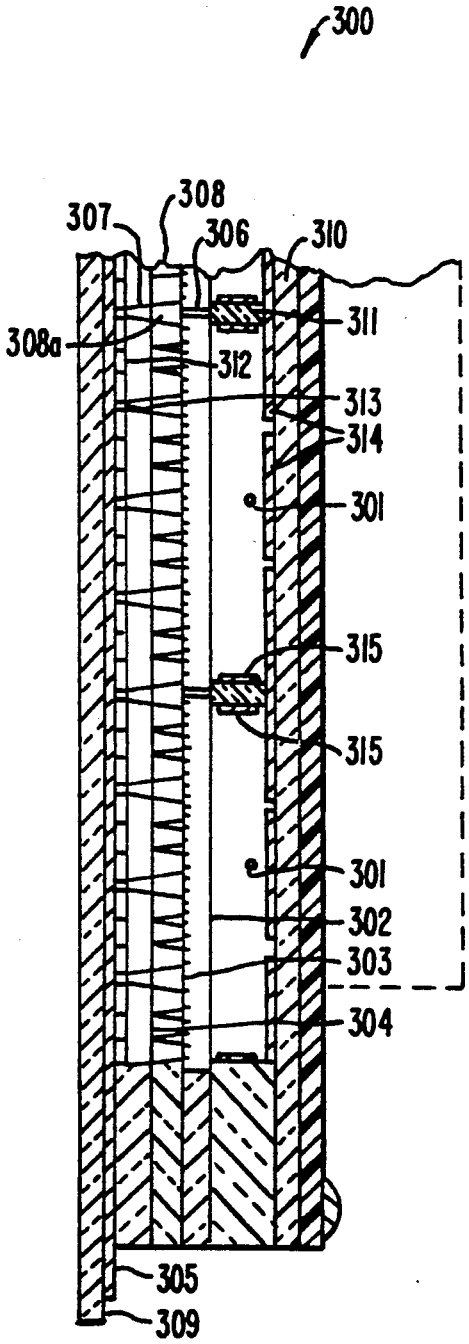
FIG. 3A is a cross-sectional view of a portion of the cathodoluminescent visual display device to illustrate an alternative embodiment of the invention.

FIG. 3A is a cross-sectional view of a portion of a cathodoluminescent visual display device 300 to illustrate an alternative embodiment of the invention. FIG. 3B is a top view of the portion of the device 300 in FIG. 3A. As shown in FIG. 3A, cathodes 301, three sets of grid electrodes 302, 303, 304, anode 305 are enclosed within a chamber between face plate 309 and back plate 310 as in FIG. 3A. Device 300 also includes a spacer plate 308 similar in structure to spacer plate 108 of FIG. 1A and spacer structures 306, 307 similar in structure to structures 106, 107 of FIG. 1A. Device 300 also includes spacer members 311 similar to members 111 of FIG. 1A, where the members 311 are placed alongside cathodes 301 and are connected to the spacer structures 306, 307 and spacer plate 308 in the same manner as in FIG. 1A for providing a rigid support to the face and back plates. Device 300 differs from device 100 of FIG. 1A in that the spacer plate 308 is placed between the second set of grid electrodes 303 (G2) and a third set of grid electrodes 304 (G3) instead of between the third set of grid electrodes and the anode as in device 100; instead, the spacer structure 307 is placed between the third set of grid electrodes and the anode. Thus if the first, second and third sets of grid electrodes are placed respectively in the first, second and third planes between the planes of the face plates 309 and the back plate 310, the spacer plates 108, 308 may be placed between either the plane of the anode and the third plane, or between the third and second planes. Preferably the face and back plates are substantially parallel to one another. Device 300 also differs from device 100 of FIG. 1A in that in device 300, the first and third sets of electrodes 302, 304 are substantially parallel to one another but are substantially perpendicular to electrodes in the second set 303 and to the cathodes 301. In device 100 in FIG. 1A, however, the first and second sets of grid electrodes 103, 102 are substantially parallel to one another but are substantially perpendicular to the third set of grid electrodes 104 and cathodes 101.

As shown in FIG. 3A, the spacer bars in structure 307 are preferably also tapered at substantially the same angle as the tapering dividing members between pixels in spacer plate 308 and are aligned therewith and are of such widths as shown in FIG. 3A so that these spacer bars and the walls 308*a* between the holes (similar to wall 250*a* of FIG. 2A) in the spacer plates 308 form an essentially smooth tapering surface to maximize the number of electrons that can be transmitted therethrough and to minimize the dark areas caused by the spacer arrangement. As in device 100, spacer plate 308 and spacer structures 306, 307 and spacer members 311 all have at least one portion along a line normal to the face and back plates abutting each other and the face and back plates to provide rigid mechanical support for the face and back plates when the chamber between the face and back plates is evacuated.

FIG. 3C is a schematic view of four pixels 350 each including three pixel dots 351 and their respective control grid electrodes for controlling the scanning and brightness of these pixels. Instead of having three wires overlapping each hole 201 corresponding to each pixel dot as shown in FIG. 2A, each of the groups G2', G2'' and G2''' includes five wires electrically connected and overlapping each pixel dot 351 (corresponding to each hole 201 of FIG. 2A) for controlling the brightness of the pixel dot that overlaps and matches such hole. As shown in FIG. 3C, the top half of each pixel is addressed by one group of scan lines, such as lines G131, and the bottom half by scan lines G132. While both the upper and lower halves of the pixel 350 may be scanned at the same time by applying identical voltages to the two groups of wires G131, G132, the two halves of the pixel may be addressed separately and treated essentially as two different pixels to increase resolution.

FIG. 3D is a schematic view of four pixels 350' each including four pixel dots 352 and the control grid lines for scanning and controlling the brightness of these pixels 352 to illustrate an alternative embodiment of the invention. As shown in FIG. 3D, each of the four pixels 350' includes a red, a blue and two green pixel dots 352. In such event, the group of electrodes for scanning the pixels should cause all four pixel dots to be scanned in order for the pixel to provide the desired correct illumination. Where the scheme of FIG. 3D is used, each hole in the spacer plate 108, 200 or 308 in FIGS. 1A, 2A or 3A should be divided by two substantially perpendicular separating walls into four smaller holes aligned with and overlapping one of the four pixel dots 352 of each pixel 350' in FIG. 3D. Obviously, other arrangements of pixel dots in the pixel may be used and other arrangements of separating walls dividing each larger hole 250 corresponding to a pixel into smaller holes matching such pixel dot arrangements may be used and are within the scope of the invention.

As shown in FIGS. 1A, 3A, spacer members 111, 311 are thicker than the bars in structures 106, 107 and 306, 307 respectively. In order to reduce any dark shadows caused by spacer structures 106, 107, 306, 307, the grid electrodes close to the bars of these structures are spaced apart at closer spacings than those further away from the bars. For the same reason, higher electrical potentials may be applied to the grid electrodes closer to the bars than those applied to the grid electrodes further away from the bars. Both features would tend to cause a greater percentage of the electrons generated by the cathode to impinge upon portions of the pixel dots that are closer to the bars, thereby compensating for the effect of the bars in blocking the electrons.

With the spacer means described above, the face and back plates may be made of glass plates that are less than about 1 mm in thickness. The grid electrodes in each of the three sets may be made of gold-plated tungsten wires of cross-sectional dimensions greater than about 5 microns. The holes 201 of FIG. 2A have dimensions greater than about 0.2 millimeters. While multi-colored phosphors are illustrated in FIGS. 3C, 3D, it will be understood that monochrome phosphors may also be used for monochrome display and is within the scope of the invention.

The sharpness and resolution of the images displayed are dependent upon the relative directions of the three sets of grid electrodes and of the cathode filaments. The four arrangements described below achieve acceptable resolution and focusing:

1. The cathode filaments are placed horizontally substantially parallel to the first and second sets of grid electrodes G1, G2. The first and second sets of grid electrodes G1, G2 are used for line scanning. The third set of grid electrodes G3 is perpendicular to the first and second sets and is used for modulating brightness of the pixel dots that are scanned.

2. The cathode filaments are placed horizontally and substantially parallel to the first and third sets of grid electrodes G1, G3; the first and third sets of grid electrodes G1, G3 are used for line scanning. The second set of grid electrodes G2 is substantially perpendicular to those of the first and third sets and is used for modulating the brightness of the pixel dots.

3. The cathode filaments are placed substantially vertically and are substantially perpendicular to the first and second sets of grid electrodes G1, G2; the first and second sets of grid electrodes are used for line scanning. The third set of grid electrodes G3 is substantially perpendicular to the first and second sets and is used for modulating brightness of the pixel dots.

4. The cathode filaments are placed substantially vertically and are substantially perpendicular to the first and third sets of grid electrodes; the first and third sets of grid electrodes G1, G3 are used for line scanning. The second set of grid electrodes G2 is substantially normal to the first and third sets and is used for modulating pixel dot brightness.

It may be preferable for the cathode filaments to be placed vertically to reduce sagging. The second and fourth electrode arrangements of using the first and third groups of grid electrodes for line scanning and a second set of grid electrodes for modulating pixel dot brightness have the advantages of low modulating voltages, low currents, and simple driving circuits.

Devices 100, 300 of FIGS. 1A, 3A may be simplified by using only two sets of grid electrodes instead of three, such as by eliminating the third set of grid electrodes 104, 304 respectively. In such event, to retain good resolution and focusing properties, the first set of grid electrodes 103, 302 are parallel to the cathode filaments and arranged in the following manner:

1. The cathode filaments are placed horizontally and substantially parallel to the first set of grid electrodes where the first set of grid electrodes G1 are used for line scanning. The second set of grid electrodes 102, 303 is substantially perpendicular to the first set of grid electrodes and are used for modulating brightness of the pixel dots.

2. The cathode filaments are vertically placed parallel to the first set of grid electrodes where the first set of grid electrodes G1 are used for modulating brightness. The second set of grid electrodes G2 is substantially perpendicular to the first set and is used for line scanning.

In the embodiments described above, different spacer arrangements are used to provide mechanical support for the face and back plates when the chamber enclosed by these plates is evacuated. The spacers may in some instances become obstacles to electrons emitted by the cathodes and cause dark areas in the cathodoluminescent visual display which is undesirable. To reduce or even eliminate such dark areas, the electric field surrounding the cathode filaments is altered to cause a greater number of electrons to impinge portions of the phosphor dots that are closer to the spacer elements than portions of the pixel dots further away from such spacer elements.

Figure 4:
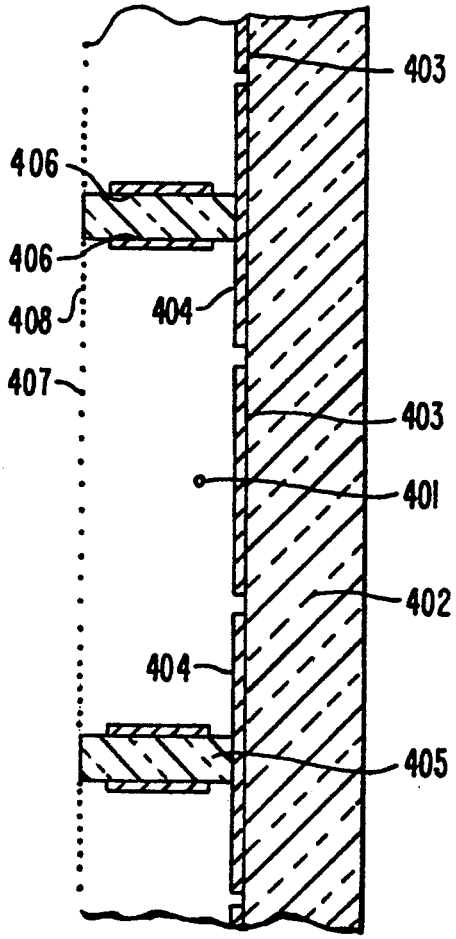
FIG. 4 is a cross-sectional view of a portion of the device of FIGS. 1A and 3A to illustrate the invention.

FIG. 4 is a cross-sectional view of a back portion of the devices 100, 300 of FIGS. 1A, 3A to illustrate one such scheme for all three electric fields surrounding the cathode filaments. In FIG. 4, 401 is a cathode filament. The inside surface of back plate 402 has a conductive layer divided into two groups: 403 and 404. The group of electrodes 403 directly faces the filament and therefore overlap the cathode filaments; the voltage applied to electrodes 403 is the same as that applied to the cathode filaments 401. Electrodes 404 do not overlap cathodes 401. Appropriate voltages are applied to electrodes 404 so that they are at a high electrical potential compared to cathode filaments 401 and electrodes 403 so that they would tend to attract electrons emitted by the filaments 401, causing more electrons to impinge phosphor dots on the anode at locations closer to spacer members 405. In the preferred embodiment, both groups of electrodes 403, 404 are substantially parallel to the cathode filaments 401 and effectively reduce shadows caused by the presence of spacer members 405 at the spacer bars 106, 107, 306, 307 also parallel to the cathode filaments.

An additional set of electrodes 406 present on both sides of spacer members 405 is also caused to be at higher electrical potentials compared to cathode filaments 401 to further attract electrons emitted by the cathode filament and cause them to travel in directions closer to spacer members 405 so as to reduce the shadows caused by the spacer members.

The first set of electrodes comprising electrodes 407, 408 are also spaced apart by such spacings as to cause more electrons to travel closer to the spacer members 405. This is achieved by causing the grid wires 408 to be at closer spacings at locations closer to the spacer members than grid wires 407 at locations further away from the spacer members. As shown in FIG. 4 this is illustrated by locating the grid electrodes so that the electrodes 408 are closer together than electrodes 407.

Yet another technique for reducing shadows caused by spacer members 405 is to apply voltages such that grid electrodes 408 are at higher electrical potentials than grid electrodes 407. The last described method concerning the grid electrodes may also be used for reducing shadows caused by spacer bars which are transverse to the cathode filament 401 by causing grid electrodes parallel to such bars to be at closer spacings at locations close to such spacer bars than at locations further away from such spacer bars and/or by applying higher voltages to such grid electrodes closer to the spacer bars than voltages applied to grid electrodes further away from the spacer bars.

A large screen CRT type television would require cathode filaments over long distances. In such event, it is desirable to employ shorter segments of cathode elements arranged in a linear array instead of one long filament because a longer filament would tend to sag. To allow for expansion and contraction of the cathode filaments, the ends of the filaments are connected to the printed circuit board, such as board 116 in FIG. 1A, by means of springs. Conventional springs typically have low resistance and would therefore be heated to a lower temperature compared to the core of the filament. This temperature differential between such spring and the end portion of the filament core will cause such end portions of the core to be at a lower temperature as well, thereby reducing the effectiveness of this portion of the filaments in emitting electrons. This factor is taken into account in constructing the linear array of cathode filaments to take the place of a very long cathode filament in a manner illustrated in FIG. 5.

Figure 5:
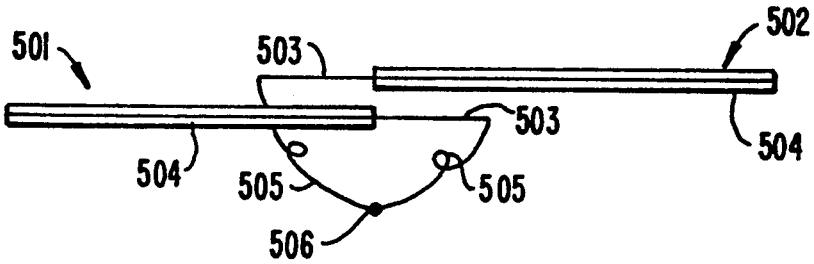
FIG. 5 is a schematic view of a portion of the cathode in FIGS. 1A, 3A.

FIG. 5 is a schematic illustration of two cathode filament segments 501 and 502. Each of the two cathode filaments includes a core 503, each connected at one end through a spring 505 to a support 506. Each filament also has a coating 504 made of a material which emits electrons when heated. As shown in FIG. 5, the two filaments are placed substantially in a linear array along the same straight line with one end of filament 501 close to an end of filament 502 where the two ends partially overlap to reduce undesirable effects caused by the ends of the filament core 503 being at a lower temperature compared to the intermediate portion of the filament, thereby reducing or eliminating any visible gaps between images displayed by the device using filaments 501, 502. Preferably, the overlapping portions of the two ends of the two filaments 501, 502 are such that the coating 504 of one filament is close to the end of the coating of filament 502 so that, as seen by the pixel dots on the anode, filament segments 501, 502 appear as one filament and as one single source of electrons with no gaps in between.

While springs 505 may be made with the same material as core 503, in some instances springs 505 may be made of stronger or thicker material compared to core 503; all such variations are within the scope of the invention. In such manner, filaments 501, 502 together form essentially a single electron source for emitting electrons uniformly along their lengths.

Figure 6:
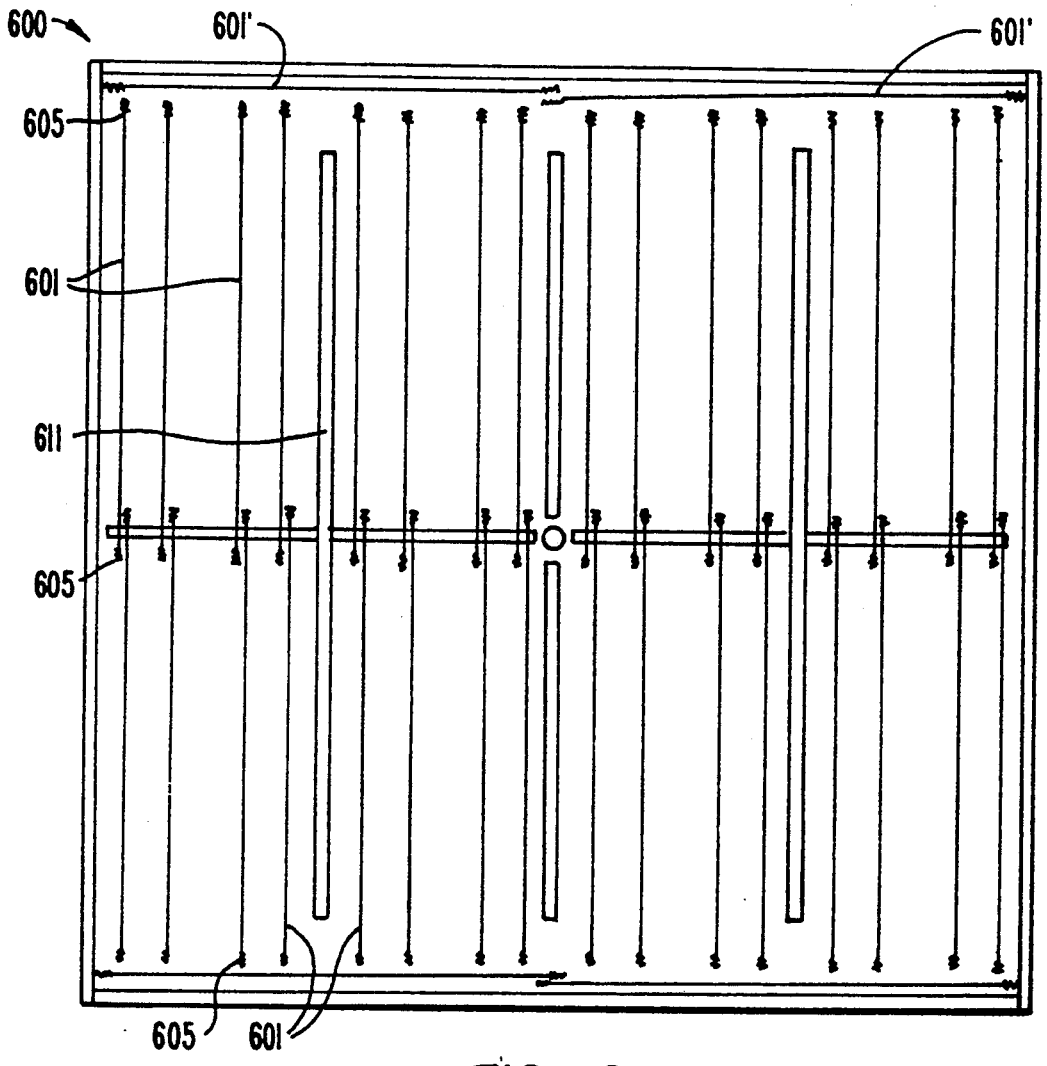
FIG. 6 is a schematic view of a cathodoluminescent display illustrating the use of additional cathodes to reduce the dark areas caused by the use of springs for mounting cathode filaments.

FIG. 6 is a schematic view of a cathodoluminescent display 600 illustrating the use of additional cathodes to reduce dark areas caused by the use of springs for mounting the cathode filaments. As shown in FIG. 6, display 600 includes an array of cathode filaments 601, each of which is mounted onto the housing by means of springs 605, where each end of the filament 601 is connected to the housing by means of a spring 605. As discussed above, the springs and the end portions of the filament connected to the springs may be at a lower temperature compared to the intermediate portion of the filament, so that fewer electrons will be emitted from the end portions, thereby causing dark areas in the display. Such dark areas may be reduced by adding additional cathode filaments such as filaments 601' adjacent to springs 605 where the filaments 601' are preferably located adjacent to the springs 605 on one side of the array of cathodes 601 to reduce the dark area of the display caused by the array of springs 605 on one side of the array of filaments 601. As shown in FIG. 6, two pairs of filaments 601' are employed, one pair at the top portion and one at the bottom portions of the display to reduce the dark areas in such portions of the display. It will be noted that the filament 601 overlaps in a manner described above in reference to FIG. 5 in the middle portion of the display so that additional cathodes may not be needed in such areas, although adding additional cathodes would serve to enhance the display.

Figure 7:
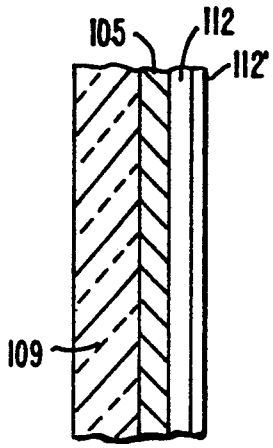
FIG. 7 is a cross-sectional view of a portion of the cathodoluminescent display of FIG. 1 to illustrate the preferred embodiment of the invention.

FIG. 7 is a cross-sectional view of a portion of the face plate, anode and phosphor layer of FIG. 1 to illustrate the preferred embodiment of the invention. When device 100 is in operation, the phosphor layer 112 is incessantly bombarded by electrons. Therefore, to lengthen the useful life of the phosphor layer 112, a protective layer 112' made of magnesium oxide or zinc oxide is employed. If a magnesium oxide layer is desired, magnesium oxide material may be deposited onto the phosphor layer 112 by means of vacuum evaporation. If the protective layer is to be made of zinc oxide, zinc material may be deposited onto the phosphor layer 112 by means of vacuum evaporation. Upon subsequent oxidation of the zinc material due to the oxygen in the air, the zinc deposited will form a protective zinc oxide layer 112'. It is preferable to employ magnesium oxide or zinc oxide as the protective layer, since such material can be penetrated easily by electrons with energy in the 2 keV–3 keV range, where the voltage across the anode and cathodes is of the order of 2 kV–3 kV volts. For cathodoluminescent displays operated at such voltages, magnesium oxide and zinc oxide are preferable to other materials such as aluminum oxide which is opaque to the penetration of electrons in such energy range. Magnesium oxide and zinc oxide are resistant to the bombardment of electrons and are effective in protecting the phosphor layer in order to increase its useful lifetime.

The above-described flat panel television panel may also be used for constructing a mosaic large-screen display, where a number of devices 100 or 300 may be arranged in one plane in a two-dimensional array to form such mosaic large-screen display. While the invention has been described above by reference to various embodiments, it will be understood that modifications and variations may be made without departing from the scope of the invention. For example, while the invention is illustrated above by reference to multi-color displays, the invention is also applicable to monochrome displays as well where the red, green and blue phosphor dots on the anode are replaced by monochrome phosphor dots. The scope of the invention is to be limited only by the appended claims.

What is claimed is:

1. A cathodoluminescent visual display device having a plurality of pixel dots for displaying images when said device is viewed in a viewing direction, comprising:

a housing defining a chamber therein, said housing having a face plate, and a back plate;

an anode on or near said face plate;

luminescent means that emits light in response to electrons, and that is on or adjacent to the anode;

at least one cathode in the chamber between the face and back plates;

at least a first and a second set of elongated grid electrodes between the anode and cathode, the electrodes in each set overlapping the luminescent means and grid electrodes in at least one other set at points when viewed in the viewing direction, wherein the overlapping points define pixel dots;

means for causing the cathode to emit electrons;

means for applying electrical potentials to the anode, cathode and the two or more sets of grid electrodes, causing the electrons emitted by the cathode to travel to the luminescent means at the pixel dots on or adjacent to the anode for displaying images; and spacer means connecting the face and back plates to provide mechanical support for the plates so that the housing will not collapse when the chamber is evacuated, said spacer means including a spacer plate defining holes therein for passage of electrons between the anode and cathode, wherein a predetermined number of one or more pixel dots correspond to and spatially overlap one hole, said spacer plate having a support wall between any two adjacent holes and one or more separation walls within at least one hole to divide said hole into smaller holes, said separation walls being thinner than the support walls, thereby reducing crosstalk.

2. The device of claim 1, wherein said anode and cathode are in two planes that are spaced apart, wherein the first and second sets of grid electrodes are in a first and a second plane respectively, said spacer means further comprising at least one net-shaped structure defining meshes that each permits electron passage to the luminescent means to address a plurality of pixel dots, said structure and said spacer plate rigidly connecting the face and back plates.

3. The device of claim 2, said housing further comprising a side plate between the face and back plates enclosing said chamber, wherein said face, side and back plates and the spacer plate are planar and have substantially the same planar dimensions, and are connected to one another at their edges to form a rigid structure.

4. The device of claim 2, said face and back plates being substantially parallel to each other, said spacer means further including elongated spacer members between the second plane and the back plate, said members connecting the structure to the back plate, wherein said structure, said spacer plate and spacer members include portions abutting each other and the face and back plates, said portions arranged along a line normal to the face and back plates forming a support for the face and back plates along said line, wherein said structure comprises bars, spaces between bars defining meshes, said members being arranged so that they and some of the bars match and abut one another and lie along lines normal to the face and back plates.

5. The device of claim 2, wherein said structure comprises bars, wherein spaces between bars define meshes, and wherein each bar matches a space between two adjacent pixels.

6. The device of claim 2, wherein said structure comprises bars, wherein spaces between bars define meshes, said bars located adjacent to portions of the grid electrodes, wherein portions of at least some of the grid electrodes adjacent to the bars are spaced apart at closer spacings than those further away from the bars to reduce any dark shadows caused by the structure.

7. The device of claim 2, wherein said structure comprises bars between meshes and adjacent to portions of the grid electrodes, and wherein the potentials applying means applies potentials to at least some of the grid electrodes adjacent to the bars that are higher than those further away from the bars to reduce any dark shadows caused by the structure.

8. The device of claim 2, wherein said spacer means includes a plurality of said net-shaped structures, said structures being in the shape of plates placed substantially in a plane adjacent to one another to form a larger plate structure.

9. The device of claim 1, wherein said anode and cathode are in two planes that are spaced apart, wherein the first and second sets of grid electrodes are in a first and second plane respectively, said spacer plate being located between the anode and the closest of the first or second plane to the anode, said spacer plate defining holes and walls therein, wherein adjacent holes are separated by a wall between the holes, said spacer means further comprising at least one net-shaped structure having meshes therein, said structure including bars attached to one another to form the structure, each of said bars being aligned with a corresponding wall, said bars and said walls being of such widths that each bar and its corresponding wall have surfaces that form a substantially smooth tapering surface to maximize the number of electrons transmitted through the holes and meshes and to minimize dark areas caused by the spacer means.

10. The device of claim 1, wherein said anode and cathode are in two planes that are spaced apart, wherein the first and second sets of grid electrodes are in a first and second plane respectively, said spacer plate being located between the first and second planes, said spacer plate defining holes and walls therein, wherein adjacent holes are separated by a wall between the holes, said spacer means further comprising at least one net-shaped structure having meshes therein, said structure including bars attached to one another to form the structure, each of said bars being aligned with a corresponding wall, said bars and said walls being of such widths that each bar and its corresponding wall have surfaces that form a substantially smooth tapering surface to maximize the number of electrons transmitted through the holes and meshes and to minimize dark areas caused by the spacer means.

11. The device of claim 1, wherein said grid electrodes are attached to said spacer means to reduce vibrations.

12. The device of claim 1, wherein said spacer plate is made of a photosensitive glass-ceramic material.

13. The device of claim 1, wherein dimensions of the holes at one side of the spacer plate are larger than those at the other side.

14. The device of claim 13, wherein the pixel dots are arranged in groups of adjacent dots, wherein each group corresponds to and overlaps one hole in the viewing direction, said spacer plate further comprising two or more separating walls separating at least one hole into smaller holes corresponding to and overlapping pixel dots of different colors, wherein each smaller hole tapers from one side of the spacer plate to the other, and wherein each smaller hole matches a pixel dot at the larger end of the hole.

15. The device of claim 13, wherein the holes at their larger dimensions match the pixel dots.

16. The device of claim 1, wherein said grid electrodes comprise wires, and wherein each hole is located so that it overlaps one wire, or two or more wires electrically connected, to form one or more electrodes for scanning the one or more pixel dots corresponding to the hole or controlling the brightness of such dots.

17. A cathodoluminescent visual display device having a plurality of pixel dots for displaying images when said device is viewed in a viewing direction, comprising:

a housing defining a chamber therein, said housing having a face plate, and a back plate;

an anode on or near said face plate;

luminescent means that emits light in response to electrons, and that is on or adjacent to the anode;

at least one cathode in the chamber between the face and back plates;

at least a first and a second set of elongated grid electrodes between the anode and cathode, the electrodes in each set overlapping the luminescent means and grid electrodes in at least one other set at points when viewed in the viewing direction, wherein the overlapping points define pixel dots;

means for causing the cathode to emit electrons;

means for applying electrical potentials to the anode, cathode and the two or more sets of grid electrodes, causing the electrons emitted by the cathode to travel to the luminescent means at the pixel dots on or adjacent to the anode for displaying images; and spacer means connecting the face and back plates to provide mechanical support for the plates so that the housing will not collapse when the chamber is evacuated, said spacer means including a spacer plate defining holes therein for passage of electrons between the anode and cathode, wherein a predetermined number of one or more pixel dots correspond to and spatially overlap one hole, thereby reducing crosstalk, wherein the pixel dots are arranged in groups of adjacent dots displaying one or more colors, wherein each group of adjacent pixel dots for displaying the color or colors correspond to and overlap one hole in the viewing direction, said spacer plate further comprising means in said one hole for separating electrons addressing one of the group of pixel dots from electrons addressing a different one of the group of pixel dots to further reduce crosstalk.

18. The device of claim 17, wherein the pixel dots are arranged in groups of three or more adjacent dots displaying the colors red, green and blue, wherein each group of three or more adjacent pixel dots for displaying the colors red, green and blue correspond to and overlap one hole, said separating means comprising two or more separating walls separating the hole into three or more smaller holes corresponding to and overlapping, dots of different colors.

19. A cathodoluminescent visual display device having a plurality of pixel dots for displaying images when the device is viewed in a viewing direction, comprising:

a housing defining a chamber therein, said housing having a face plate and a back plate;

an anode on or near said face plate;

luminescent means that emits light in response to electrons, and that is on or adjacent to the anode;

at least one elongated cathode in the chamber between the face and back plates;

at least a first and a second set of elongated grid electrodes between the anode and cathode, the electrodes in each set overlapping the luminescent means and electrodes in at least one other set at points when viewed in the viewing direction, wherein the overlapping points define pixel dots;

means for heating the cathode, causing the cathode to emit electrons in an electron cloud;

means for applying electrical potentials to the anode, cathode and the two or more sets of grid electrodes, causing the electrons emitted by the cathode to travel to the luminescent means at the pixel dots on or adjacent to the anode for displaying images;

spacer means connecting the face and back plates to provide mechanical support for the plates so that the housing will not collapse when the chamber is evacuated, said spacer means including elongated spacer members alongside the cathode, said members located between the back plate and the grid electrodes, between the sets of grid electrodes or between the grid electrodes and the anode; and a first set of one or more elongated shadow reducing electrodes adjacent to the spacer members, wherein said potentials applying means applies to the shadow reducing electrodes a potential that is higher than that applied to the cathode by the potentials applying means, causing electrons in the electron cloud emitted by the cathode to spread laterally before travelling towards the anode to thereby reduce any shadows caused by the spacer members.

20. The device of claim 19, further comprising a second set of shadow reducing electrodes between the back plate and the cathode, said second set of shadow reducing electrodes adjacent to the cathode, wherein said potentials applying means applies substantially the same potential to the cathode and the second set of shadow reducing electrodes.

21. The device of claim 19, wherein said first set of shadow reducing electrodes is located on the back plate.

22. The device of claim 19, wherein at least some of said spacer members are located between the back plate and the grid electrodes and have surfaces that face the cathode, and wherein at least some of said first set of shadow reducing electrodes are located on such surfaces of the spacer members and are facing the cathode.

23. A cathodoluminescent visual display apparatus comprising a mosaic of devices arranged side by side to form a larger display, each device having a plurality of pixel dots for displaying images when viewed in a viewing direction and comprising:

a housing defining a chamber therein, said housing having a face plate and a back plate;

an anode on or near said face plate;

luminescent means that emits light in response to electrons, and that is on or adjacent to the anode;

at least one cathode in the chamber between the face and back plates;

at least a first and a second set of elongated grid electrodes between the anode and cathode, the electrodes in each set overlapping the luminescent means and electrodes in at least one other set at points when viewed in the viewing direction, wherein the overlapping points define pixel dots;

means for heating the cathode, causing the cathode to emit electrons;

means for applying electrical potentials to the anode, cathode and the two or more sets of grid electrodes, causing the electrons emitted by the cathode to travel to the luminescent means at the pixel dots on or adjacent to the anode for displaying images; and spacer means connecting the face and back plates to provide mechanical support for the plates so that the housing will not collapse when the chamber is evacuated, said spacer means including a spacer plate defining holes therein for passage of electrons between the anode and cathode, wherein a predetermined number of one or more pixel dots correspond to and spatially overlap one hole, thereby reducing crosstalk, said spacer plate having a support wall between any two adjacent holes and one or more separation walls within at least one hole to divide said hole into smaller holes, said separation walls being the inner than the support walls.

* * * * *

UNITED STATES PATENT AND TRADEMARK OFFICE

CERTIFICATE OF CORRECTION

PATENT NO. : 5,229,691

DATED : July 20, 1993

INVENTOR(S) : Shichao et al.

It is certified that error appears in the above-identified patent and that said Letters Patent is hereby corrected as shown below:

Column 17, Claim 18, line 38: delete ","
insert --pixel--

Column 18, Claim 23, line 67: delete "the inner"
insert --thinner--

Signed and Sealed this

Eighth Day of March, 1994

Bruce Lehman

BRUCE LEHMAN

*Commissioner of Patents and Trademarks*

*Attest:*

*Attesting Officer*